US011250962B1

(12) United States Patent
Singh

(10) Patent No.: US 11,250,962 B1
(45) Date of Patent: Feb. 15, 2022

(54) MANUFACTURING METHODS TO FORTIFY NUCLEAR WASTE CANISTERS FROM STRESS CORROSION CRACKING

(71) Applicant: Holtec International, Camden, NJ (US)

(72) Inventor: Krishna P. Singh, Hobe Sound, FL (US)

(73) Assignee: Holtec International

( * ) Notice: Subject to any disclaimer, the term of this patent is extended or adjusted under 35 U.S.C. 154(b) by 1170 days.

(21) Appl. No.: 15/709,098

(22) Filed: Sep. 19, 2017

Related U.S. Application Data

(60) Provisional application No. 62/396,565, filed on Sep. 19, 2016.

(51) Int. Cl.
*G21F 5/008* (2006.01)
*G21F 5/12* (2006.01)

(52) U.S. Cl.
CPC ..... *G21F 5/008* (2013.01); *G21F 5/12* (2013.01); *G21Y 2002/103* (2013.01); *G21Y 2002/104* (2013.01)

(58) Field of Classification Search
CPC ..... B23K 26/00; B23K 26/24; B23K 26/26; B23K 26/262; B23K 26/28; B23K 26/282; B23K 2101/06; B23K 2101/10; G21F 5/002; G21F 5/005; G21F 5/008
USPC ..... 219/121.64, 121.63, 78.01, 101, 104
See application file for complete search history.

(56) References Cited

U.S. PATENT DOCUMENTS 2,329,410 A 9/1943 Morrison
3,927,292 A * 12/1975 Worden ..... B23K 31/027 219/67
4,129,062 A * 12/1978 Bergmann ..... B23D 79/021 409/140
4,320,277 A * 3/1982 Taira ..... B23K 9/1735 219/61
5,670,072 A 9/1997 Offer et al.
(Continued)

OTHER PUBLICATIONS

Paul Denney, "Hybrid Laser Arc Welding—Has Its Time Finally Arrived?", Lincoln Electric Corporation, pp. 1-4, www.lincolnelectric.com/automated-solutions, 22221 Saint Clair Avenue, Cleveland, Ohio 44117-2522.
(Continued)

*Primary Examiner* — Tu B Hoang
*Assistant Examiner* — Alba T Rosario-Aponte
(74) *Attorney, Agent, or Firm* — The Belles Group, P.C.

(57) ABSTRACT

Manufacturing methods for fabricating nuclear waste canisters used to store spent nuclear fuel assemblies are disclosed to mitigate stress corrosion cracking. The method may generally comprise providing one or more stainless steel sheets used to form a shell of the canister. The shell comprises open butt joints which are welded closed via full shell thickness type welds of preferably narrow profile. The welds and adjoining heat affect zone may then be subjected to mechanical through-thickness compaction, which converts a residual tensile stress field in the shell base material adjoining the weld to a compressive stress field for a full thickness of the shell. The crown of the external exposed portion of the weld is flattened by the compaction and may be coplanar with the exterior surface of the shell. Surface peening may optionally be performed on the welded zone after compaction.

13 Claims, 4 Drawing Sheets

(56) References Cited

U.S. PATENT DOCUMENTS

| | | | | |
|---|---|---|---|---|
| 6,216,511 | B1 * | 4/2001 | Ohnishi | B21C 37/0811 72/113 |
| 6,375,059 | B2 * | 4/2002 | Ohnishi | B21C 37/0811 228/112.1 |
| 2063/0024913 | | 2/2003 | Offer et al. | |
| 2004/0099644 | A1 * | 5/2004 | Allen | B23K 26/348 219/121.64 |
| 2011/0248070 | A1 * | 10/2011 | Furfari | B23K 20/126 228/112.1 |
| 2013/0136540 | A1 * | 5/2013 | Jones | F16L 58/181 405/170 |
| 2015/0048146 | A1 * | 2/2015 | Knoop | B21C 37/08 228/102 |
| 2016/0033059 | A1 * | 2/2016 | Fonte | C22C 19/055 138/171 |

OTHER PUBLICATIONS

A. Machiels (EPRI Project Manager), "Effects of Marine Environments on Stress Corrosion Cracking of Austenitic Stainless Steels", Sep. 2005, Electric Power Research Institute (EPRI), Inc., www.epri.com, 3420 Hillview Avenue, Palo Alto, California 94304-1395.

U.S. Nuclear Waste Technical Review Board, "Chloride-Induced Stress Corrosion Cracking Potential in Dry-Storage Canisters for Spent Nuclear Fuel", pp. 1-5, Mar. 1, 2017.

* cited by examiner

MANUFACTURING METHODS TO FORTIFY NUCLEAR WASTE CANISTERS FROM STRESS CORROSION CRACKING

CROSS-REFERENCE TO RELATED APPLICATIONS

The present application claims the benefit of priority to U.S. Provisional Application No. 62/396,565 filed Sep. 19, 2016; the entirety of which is incorporated herein by reference.

BACKGROUND OF THE INVENTION

The present invention generally relates to manufacturing methods for metal vessels, and more particularly to a method for fabricating a welded metal canister such as those used in the nuclear power generation industry.

The canister used to store hazardous materials such as used or spent nuclear fuel (SNF) is typically made from multiple courses of shell segments butt welded to each other leading to discrete linear seams or joints, thereby forming circumferential joints as shown. In addition, each shell segment in turn may also be formed of a cylindrically rolled plate or sheet of material which is butt welded at the adjoining ends or edges forming longitudinal joints. The typical material of construction used to store high level nuclear waste is austenitic stainless steel. Stainless is extremely ductile, has a high fracture resistance at even cryogenic temperatures and it resists corrosion in a wide variety of environments. These properties of stainless steel have made it a prized material for making components that may be exposed to adverse environmental conditions in open air settings. In the nuclear power industry, the canisters used to store used nuclear fuel (often called the multi-purpose canister or "MPC") are almost always made from a stainless alloy. While the wide usage of austenitic stainless steel is grounded on its solid track record, a stainless weldment has one notable vulnerability: the material is susceptible to stress corrosion cracking (SCC) if its exposed surface has a tensile stress field and is subjected to a prolonged exposure to a salt-laden atmosphere such as a chloride or halide-bearing moist marine air of certain relative humidity. It is recognized that residual tensile stresses created in the weld and adjoining heat affected zones (HAZ) by welding the canister shell are a source of such stress fields. A high level of tensile stress on the exposed surface, humid air, and a salt species must be all present to initiate stress corrosion cracking.

Prior experience shows that a stainless shell of an MPC withstands humid marine air and have remained intact (without any breach) for decades in service which provides comforting assurance to the canister users in the nuclear industry. There is general consensus in the scientific community that there is no credible threat to the integrity of the canisters stored even in salt air environments for several decades. However, the potential for eventual degradation has been sufficient to prompt the efforts to extend the canister's service life. Towards this end, several organizations in the nuclear industry have launched programs for comprehensive "Aging Management" of MPCs.

A need exists for an improved welded nuclear waste storage canister which can prolong the onset of SCC.

SUMMARY OF THE INVENTION

In this present disclosure, certain preemptive measures effective against stress corrosion cracking (SCC) in the MPC are presented that can be implemented during the nuclear waste canister's fabrication to forestall the incidence of SCC after prolonged exposure in an adverse ambient environment for many more decades. The first measure generally comprises using a welding process which minimizes the quantity of weld metal for making a thru-thickness but weld, such as for example by hybrid laser welding. If a double bevel conventional welding technique such as MIG or submerged arc welding must be used, then the weld is preferably made from the outside first to minimize the size of the outer exposed bevel and thus amount of filler wire. By making the outside weld first, the weld can shrink freely thus minimizing residual tensile stress imparted to the HAZ of the shell by welding. A direct result of the reduced weld mass is reduction in the magnitude and extent of the tensile stress particularly on the outer exposed surface of the weld and the HAZ which forms a potential initiation site for SCC.

The second measure generally comprises forcibly compacting and compressing the exterior convex weld crown to plastically deform and flatten it causing a through-thickness compaction (TTC) and state of compressive stress in the HAZ. The size of the crown to yield best results may preferably be determined by a finite element analysis using the actual geometry of the weld, material properties of the base and weld materials, and thickness of the canister shell parts being joined. Preferably, the foregoing two measure or techniques can be used together for best results. Optionally, surface peening may be applied subsequently to weld and HAZ after TTC to further reinforce the state of compressive stress in the weld region.

A method or process for fabricating a nuclear waste canister weldment formed from stainless steel plate or sheet susceptible to SCC may therefore generally include in one embodiment forming a weld at a seam or joint in the sheet or sheets, and compressively compacting and flattening the weld with sufficient force to convert the residual stress field in the weld and HAZ resulting from welding to a compressive stress field for a full depth or thickness of the shell base material. The weld preferably may be formed of a type and with profile characteristics which reduce tensile stresses initially created in the weld and HAZ by heat produced during the welding operation, thereby mitigating or postponing the occurrence of stress corrosion cracking (SCC) in these vulnerable zones. As noted above, the compaction and flattening step convert the tensile stresses created in the weld and HAZ material of the shell base material to a full depth or thickness of the weld and base material. The peening step may optionally be used after TTC to impart a further degree of compressive stresses in the weld and HAZ at the outer surface region of the canister shell (i.e. less than full depth), thereby forming an additional shield against SCC.

In one aspect, a method for fabricating a nuclear waste canister comprises: providing a stainless steel sheet or sheets for a nuclear waste canister, the sheet or sheets including an exterior surface, an interior surface, and an open joint defined between adjacent edges of the sheet or sheets; forming a full thickness weld in the open joint, the weld extending from the interior surface of the sheet or sheets to a convexly rounded crown at the exterior surface of the sheet or sheets; compressing the weld for a full thickness of the weld; and flattening the crown of the weld such that the crown after compressing is substantially flush with the exterior surface of the sheet or sheets adjoining the weld.

In another aspect, a method for fabricating a nuclear waste canister comprises: providing a stainless steel shell or shells for a nuclear waste canister, the shells or shells including an exterior surface, an interior surface, a thickness defined therebetween, a pair of spatially separated opposing edges to be joined defining an open weld joint; and forming a full thickness weld in the weld joint by first forming an exterior weld mass at an exterior of the weld joint followed by forming an interior weld mass at an interior of the weld joint, the weld extending from the interior surface to the exterior surface of the shell or shells.

In another aspect, a method for fabricating a nuclear waste canister comprises: providing a stainless steel shell or shells for a nuclear waste canister, the shells or shells including an exterior surface, an interior surface, a thickness defined therebetween, and an open weld joint; forming a full thickness weld in the weld joint; and compressing the full thickness weld from the interior surface to the exterior surface of the shell or shells.

In another aspect, a nuclear waste canister comprises: a welded cylindrical stainless steel shell having a thickness and including an exterior surface, an interior surface, and an interior space configured for storing nuclear waste; the shell comprising at least one full thickness butt weld extending from the interior surface to the exterior surface of the shell, the butt weld defining an adjoining heat affected zone resulting from formation of the weld; the weld and heat affect zone of the shell being compacted for an entirety of the thickness of the shell such that a compressive stress field exists in the weld and heat affect zone from the interior surface to the exterior surface.

Further areas of applicability of the present invention will become apparent from the detailed description hereafter and drawings.

BRIEF DESCRIPTION OF THE DRAWINGS

The features of the exemplary embodiments will be described with reference to the following drawings where like elements are labeled similarly, and in which:

All drawings are schematic and not necessarily to scale. Parts shown and/or given a reference numerical designation in one figure may be considered to be the same parts where they appear in other figures without a numerical designation for brevity unless specifically labeled with a different part number and described herein. References herein to a whole figure number (e.g. FIG. 1) shall be construed to be a reference to all subpart figures in the group (e.g. FIGS. 1A, 1B, etc.) unless otherwise indicated.

DETAILED DESCRIPTION OF THE INVENTION

Figure 1:
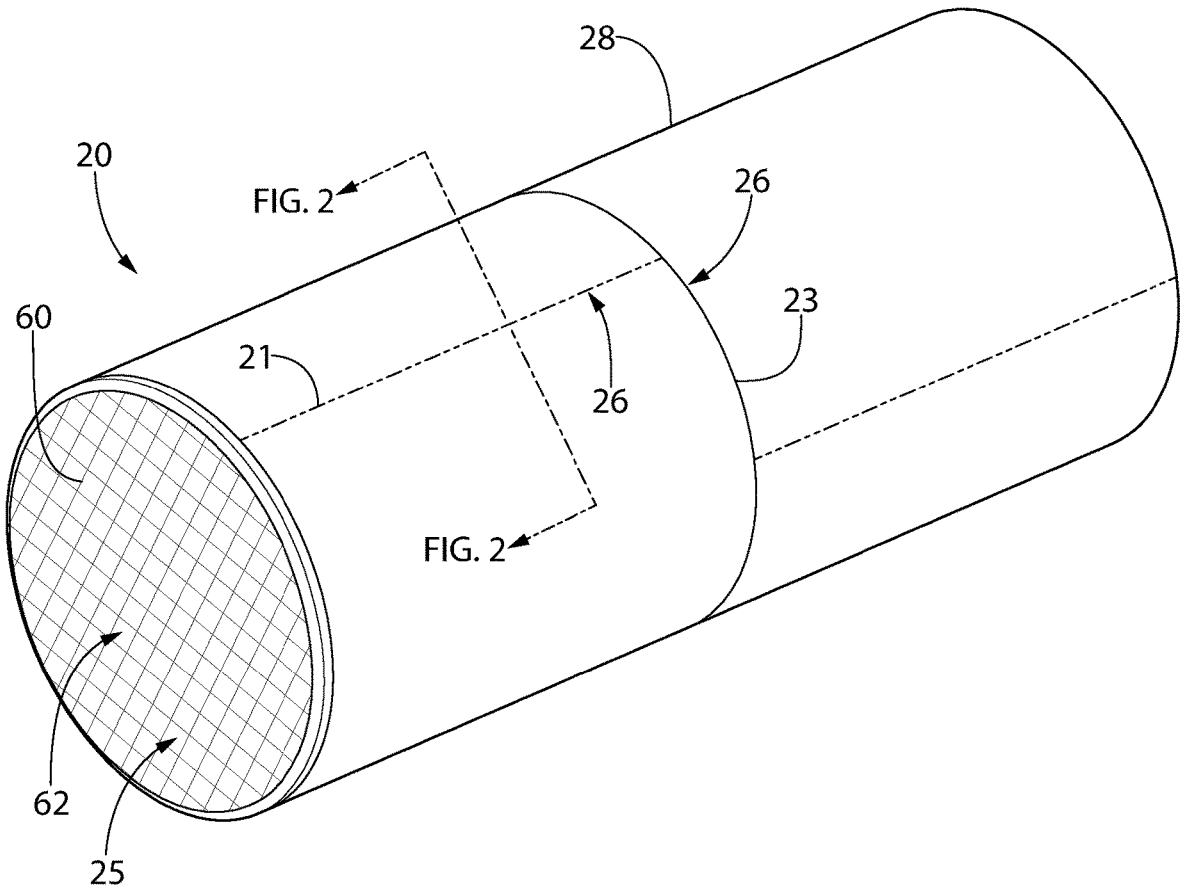
FIG. 1 is a perspective view of the shell weldment of a nuclear waste canister for storing spent nuclear fuel.

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

To devise the remedial measures, it is important to recognize that the weld seams in the canister are locations of the highest tensile stress. The through-thickness welds extending from the interior to exterior of the shell plates or sheets made to join the shell courses, as explained later, are intrinsically vulnerable locations where the stress field on the surface is severely tensile. Predictably, these locations are prime candidates for initiation of stress corrosion cracking (SCC). The proven method to deal with this problem is surface "peening" which involves applying concentrated impulsive pressure on the target surface to create a layer of compressive in-plane stress which serves as an armor against nucleation of SCC sites under a sustained exposure to salt air. However, surface peening can only produce a compressive layer to a limited depth in the shell base material such as for example as deep as 4 mms which, as test data shows, may be generally adequate to protect against SCC in many ambient environments. In certain harsh marine environments, however, peening alone may be not provide sufficient protection and service life.

Although surface peening can be used as a generally effective means to make the stress field in the welded region compressive over its external surface in the weld zone subsequent to the manufacturing of the canister, the techniques presented in this disclosure can be used as supplemental to peening or as stand-alone measures to further enhance protection against SCC and extend the service life of the MPC and other weldments.

Figure 2:
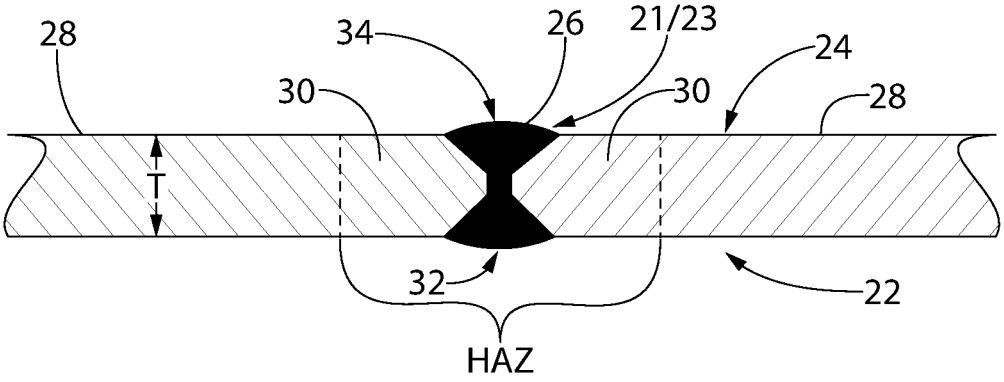
FIG. 2 is a cross-sectional view of a first type of full thickness butt weld used to form the shell.

Referring to FIGS. 1 and 2, the method or process for fabricating a welded spent nuclear fuel (SNF) canister 20 to mitigate or postpone the onset of SCC begins with first forming the circumferential and/or longitudinal welds 26 at the seams or joints in the shell 28 of the SNF canister. The shell 28 of a nuclear waste canister 20 is generally formed from plates or sheets of stainless steel such as austenitic stainless steel having a thickness T. As shown, the shell 28 of canister 20 may typically be a welded structure formed from a plurality of linearly stacked cylindrical shell courses or segments welded together at circumferential joints 23. Each shell segment may in turn be a welded component including one or more longitudinal joints 21 at which opposing longitudinal ends or edges of the shell segment are welded to seal the segment. The welds 26 used for joining sections of the shell at either the longitudinal joints 21 or circumferential joints 23 are full thickness through welds extending from the interior surface 22 of the canister to the exterior surface 24. The term "exterior surface" means the surface of the weldment that will be exposed to a corrosive halide or chloride environment that has the potential for initiating SCC. The canister shell 28 has a cylindrical shape that defines an interior space 25 configured for holding a fuel storage basket 60 having a multiplicity of open cells 62 that hold the spent nuclear fuel assemblies, as is well known in the art. Spent fuel canisters having such basket structures are disclosed in commonly-owned U.S. Pat. No. 9,748,009, which is incorporated herein by reference in its entirety. All canister butt welds 26 are preferably hermetically sealed welds to prevent escape of radioactive contaminants to the outer environment from nuclear fuel stored inside the canister 20.

The first measure proposed herein to mitigate the onset of SCC is selecting a type of weld 26 and/or forming the weld in a manner that minimizes the heat input to the shell 28. This will reduce the size of the heat affected zone (HAZ) which creates the initiation sites for SCC due to the tensile stresses created in the HAZ resulting from heating the shell base material during the welding process. FIG. 2 shows a conventional double bevel joint or double V-groove butt weld that may be used with aspects of the present invention and process for forming a welded SNF canister. The weld seam or joint shown may be longitudinal or circumferential joint 21 or 23. Two opposing shell ends or edges 30 are shown in spaced apart relationship forming an open weld joint 21 or 23. The joint thus formed may be linear in one embodiment (see, e.g. FIG. 1) whether longitudinally or circumferentially extending. The edges 30 may be substantially coplanar and parallel to each other (allowing for shop fabrication dimensional tolerances) to form a generally uniform gap therebetween for receiving the weld material deposited by a consumable welding rod, wire, or electrode (not shown). In FIG. 2, the shell end weld preparations for welding are configured to create a profile that forms a standard double V-groove as shown.

Figure 3:
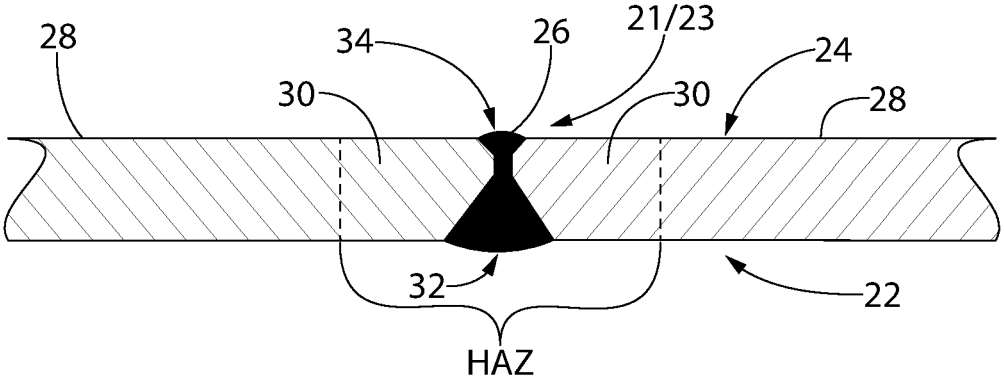
FIG. 3 is a cross-sectional view of a second type of full thickness butt weld used to form the shell.

According to one aspect of the present invention, if a double bevel joint or double V-groove weld is used as shown in FIG. 2, the bevel at the interior surface 22 of the shell 28 preferably may be made larger instead and the bevel at the exterior surface 24 may be made as small as possible when the joint is welded. FIG. 3 shows such a configuration. The enlarged interior weld mass 32 of the weld is noticeably larger than the enlarged exterior weld mass 34. Advantageously, this reduces the heat input during the welding process to make the smaller exterior weld bevel, thereby resulting in smaller tensile stress field in the HAZ on the exterior which is the potential initiation site for SCC that is exposed to the corrosive salt-laden marine environment. As opposed to the completely symmetrical shell weld end preparations of the standard double V-groove weld shown in FIG. 2, the end preparations in FIG. 3 are asymmetrical such that the exterior V-groove is smaller than the interior V-groove for receiving the weld material.

In conjunction with formation of the asymmetrical double V-groove weld shown in FIG. 3, the weld 26 at the joints 21 or 23 is preferably made from the outside first followed by the weld from the inside. This is opposite to the standard practice used in welding cylindrical vessels, which seeks to minimize welding inside confined spaces. Accordingly, the exterior weld mass 34 is formed first followed by the interior weld mass 32. Therefore, this welding sequence which is the obverse of the welding sequence in FIG. 2 will minimize the tensile stress in the outer surface and the associated heat affected zone (HAZ). The interior weld may be ground flush after formation. A small convex weld crown left on the outside may be left for further mechanical work to further mitigate the onset of SCC, as further described herein. Preferably, the welding process is performed to avoid angular distortion of the workpiece. It bears noting that in all applicable embodiments describe herein, the interior and exterior weld masses 32, 34 are joined in the intermediate section of the joint 21/23 which forms the full thickness butt weld.

Formation of the full thickness welds 26 in FIG. 3 may be completed via any suitable conventional welding process in a manner known in art generally involving the use of a non-consumable electrode or consumable welding electrodes, wires, or rods to deposit or form weld material in the joints 21 or 23 via successive passes through the weld joints. With each pass of the welding electrode or rod, the weld material is fed into the joint and gradually built up in layers or beads to the final profile shown. The weld bevels shown includes a convexly shaped broad face or crown at one end and a narrow root at the base of the weld bevel. Non-limiting examples of weld processes that may be used include gas metal arc welding (GMAT), gas tungsten arc welding (GTAW), shield metal arc welding (SMAW), flux cored arc welding (FCAW), submerged arc welding (SAW), and others. These welding processes are well known in the art without undue elaboration.

Figure 4:
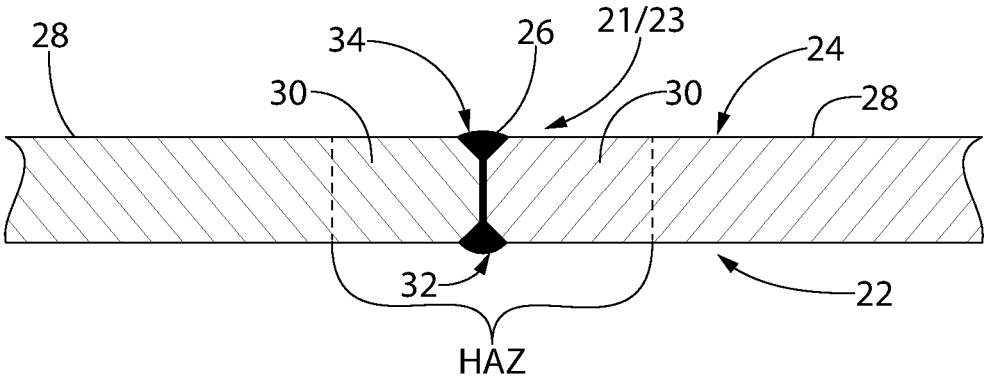
FIG. 4 is a cross-sectional view of a third type of full thickness butt weld used to form the shell.

According to another aspect of the invention, narrow joint or groove type welding techniques may also be used to minimize the extent of the HAZ in the base material of the shell 28 adjacent the joint for mitigating initiation of SCC. FIG. 4 depicts a full or through thickness double sided submerged arc butt weld having a narrow profile groove. As seen, both the interior and exterior weld masses 32, 34 having weld bevels generally smaller than conventional double V-groove welds as shown in FIG. 2. The lateral width of the weld between the bevels is also narrower than the conventional double V-groove weld. The narrow weld profile of FIG. 4 results in a reduced width HAZ and concomitantly smaller tensile stress field which is beneficial for mitigating the onset of SCC.

Figure 5:
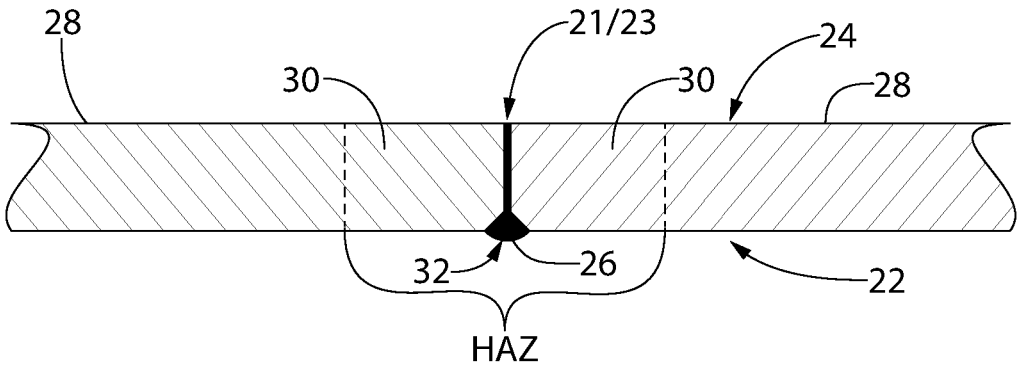
FIG. 5 is a cross-sectional view of a fourth type of full thickness butt weld used to form the shell.
Figure 6:
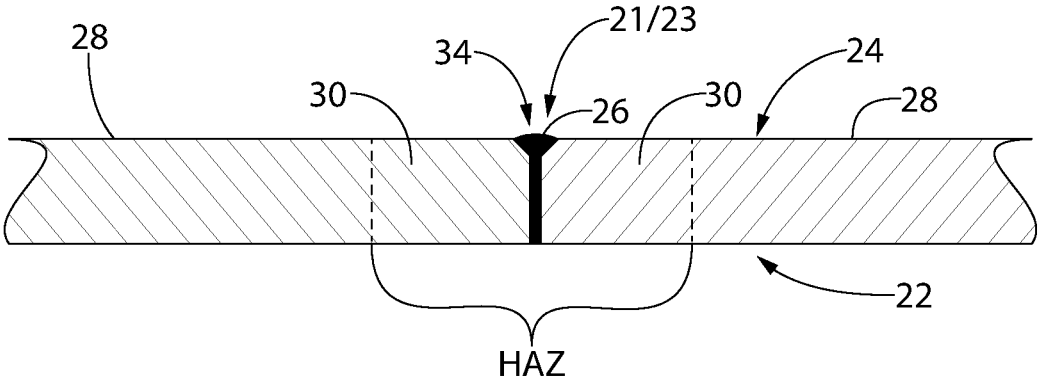
FIG. 6 is a cross-sectional view of a fifth type of full thickness butt weld used to form the shell.

FIG. 5 depicts another example of a full or through thickness hybrid laser weld having a narrow profile groove formed by the hybrid laser arc welding (HLAW) technique. Hybrid laser welding generally combines the use of a laser with GMAW or GTAW and is well known in the art without undue elaboration. This welding technique absolutely and advantageously minimizes the heat input imparted to the shell required to complete the butt weld. HLAW requires less than ¼th of the heat input required by the some non-laser welding processes noted above and produces a smaller crown on the inside (FIG. 5) or outside (FIG. 6) whose size can be adjusted by the weld wire feed rate. The result is an extremely narrow weld profile with greatly reduced HAZ in the canister shell base material. Forming the HLAW weld from inside of the canister shell 28 which is the obverse of standard industry practice results in no significant crown on the exterior surface of the shell, as shown in FIG. 5. This is further advantageous for reducing the probability of SCC initiation at the exterior surface of the shell in the HAZ.

According to another aspect of the invention, a second measure to mitigate the onset of SCC at the exterior surface of the canister shell 28 in the HAZ is full or through-thickness compaction (TTC). It will be recalled that the welding process creates a tensile stress field in the HAZ of the canister shell (which includes the weld mass), which is one of three conditions necessary for SCC initiation. In one embodiment, the process for fabricating a welded SNF canister 20 comprises mechanically working the weld and HAZ to change the stress field in the weld and HAZ region from tensile to compressive for the full thickness T of the material using TTC. This process is referred to herein as "through-thickness compaction (TTC)." It is important to note that TTC contrasts to and is different from the effect of surface peening, which is only capable of inducing a compressive in-plane stress field in a 2 to 4 mm depth of the shell base material from the exterior surface 24 of the canister shell 28, but leaves a corresponding tensile stress field in the layer below to the interior surface 22. Advantageously, the TTC process changes the stress field to compressive from the exterior surface 24 of the shell 28 to the interior surface 22 for an added level of protection against SCC.

The TTC method or process generally comprises two steps or stages. First, shape the outer surface of the weld crown during the weld formation process, as guided by an elastic-plastic finite element analysis explained below to the optimal size. The extent of required crown is quite small; it should be based on the extent of flattening via TTC needed to induce at least 5%, but no more than 10%, maximum compressive strain in the weld mass and HAZ after TTC. Second, the use a mechanical compression or compaction process to flatten the crown rendering the top surface of the HAZ flush or coplanar with the adjacent exterior surface 24 of the shell 28. The term coplanar means that for a flat sheet or sheet of shell material, the crown would be lie in the same flat plane as the portions of the sheet(s) adjoining the weld. For a rolled or contoured shell, the crown would lie in the same cylindrical plane as the sheet(s) adjoining the weld.

Figure 7:
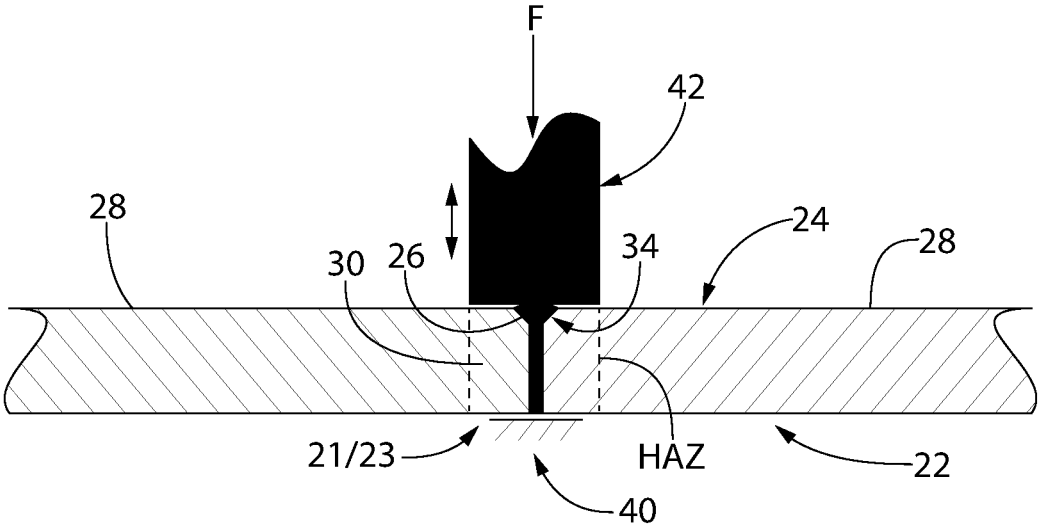
FIG. 7 is a cross-sectional view of the butt weld of FIG. 6 showing a mechanical weld compaction device used to compress the weld for a full thickness of the shell and flatten the crown of the weld.

Cold rolling or flattening the crown and adjoining HAZ by applying a targeted compressive force on it (see, e.g. FIG. 7), as the classic theory of plasticity teaches, will produce a compressive in-plane stress field in the weld mass and its adjacent heat affected zone. The compaction force F should preferably be of sufficient magnitude to convert the residual tensile stress field resulting from welding to a compressive stress for the full thickness T of the canister shell 28. Accordingly, the in-plane stress field will be compressive across the entire thickness of the welded region (i.e. weld and HAZ) for the interior to exterior surface 22, 24.

Mechanically working the weld and HAZ via TTC can be performed using a variety of commercially available processes and machines. As one example, the compaction device may be a suitably sized "rolling mill" using rollers as a compaction member 42 to apply the necessary compaction or compressing pressure or force F to the canister shell base material in the HAZ and weld for in-plane flattening. The interior side of the weld 26 and HAZ inside the canister shell 28 is supported via a rear support member 40, which may be flat steel plate or other type structure in some embodiments. The weld and HAZ of the canister shell is compressed or compacted between the back support member 40 and the compaction member 42 in a squeezing type action. In other embodiments, TTC flattening may be performed by a suitable forging technique. For example, a hammer forge type machine may be used as the compaction device which comprises an axially reciprocating die or hammer for the compaction member 42 to shape the weld crown by creating localized compressive forces in the weld and adjoining HAZ material. The hammer may be pneumatically driven to repetitiously strike the crown of the weld 26 and adjoining HAZ with sufficient compaction force F for a predetermined period of time to flatten the weld crown in-plane with the canister shell outer surface 24 and concomitantly create a full depth compressive stress field in the HAZ and weld. It is well within the ambit of those skilled in the art to select an appropriate mechanical compaction or compression machine and process parameters to achieve the foregoing desired results and end product weldment. It will be appreciated that required force F for TTC cannot be delivered via manual means (e.g. manually wielded hammers or similar methods).

The shell weldment resulting from TTC will exhibit a compressive stress field for the full thickness T of the shell in the weld and HAZ. Such a stress field condition could be verified by SEM (scanning electron microscope) or other metallurgical examination techniques used in the art. These examination techniques are capable of generally identifying the microstructure of the weld and HAZ material to disclose information about the types of processes used on the material during fabrication such as TTC.

Following the TTC treatment of the weld 26 and adjoining HAZ of the shell base material, the top surface of the weld crown is flattened and rendered flush or coplanar with the adjacent portions of the exterior surface 24 of the canister shell 28. Notably, the top surface of the weld is coplanar with the exterior surface of the shell without the use of mechanical grinding, which is a technique commonly used in industry to eliminate the crowns of welds resulting in a flush outer surface. In some embodiment, the thickness T of the weld base material may actually be slightly smaller or thinner in thickness T at weld and HAZ location than adjacent portions of the shell 28 due to the TTC process.

It bears noting that the TTC process may be performed when the shell sheet or sheets are either in a flat condition or a curved/contoured condition after rolling and bending. The former might be used if a shell segment includes more than one longitudinal weld joint.

Combining peening the welded region with TTC explained above after TTC can be used to further increase the compressive stresses in the top layer making the shell's exterior surface armor against salt air attack even stronger. The alleged drawback of surface peening, namely leaving an undesirable tensile stress field in the shell layers below 2-4 mm in depth will also be ameliorated because of the compressive pre-stress generated by the full "through-thickness compaction" before peening according to the TTC process disclosed herein.

Figure 8:
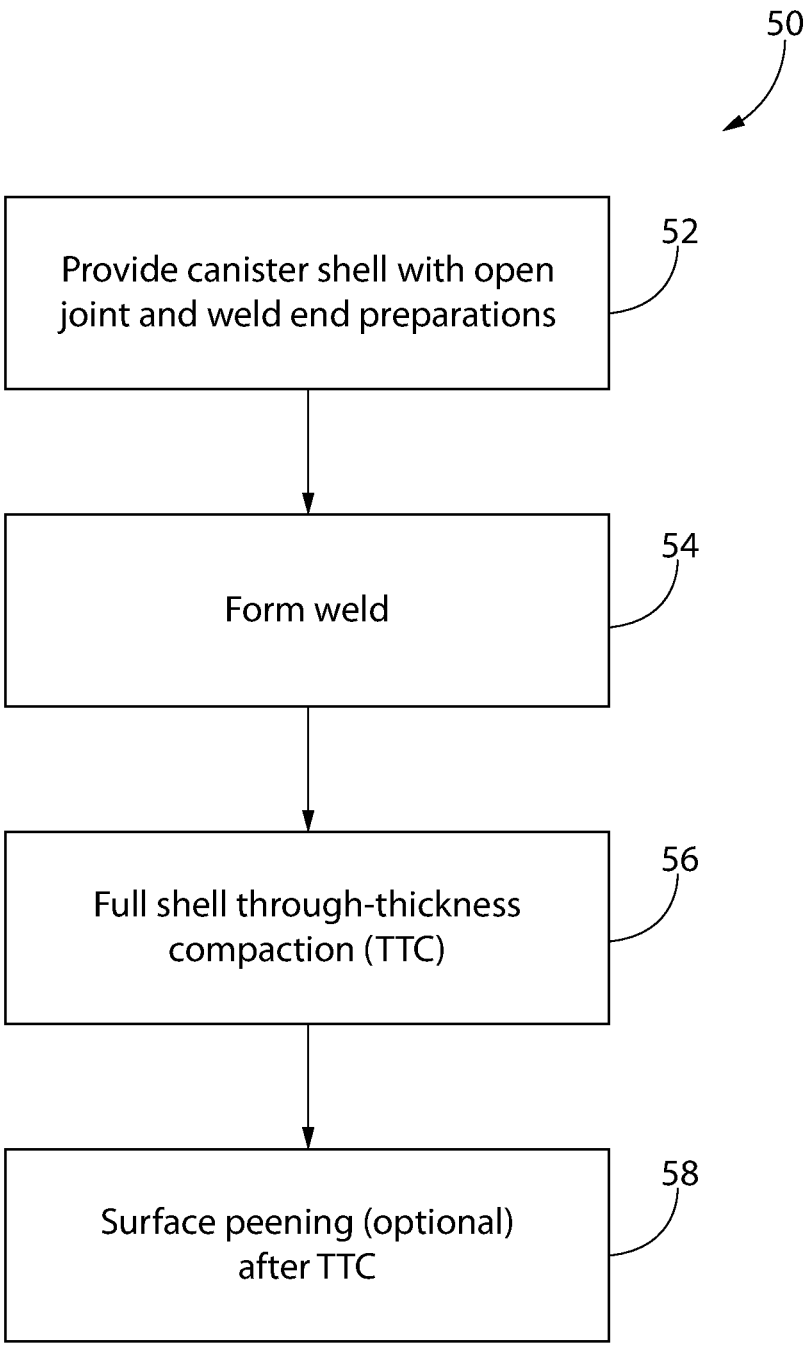
FIG. 8 is a flow chart showing steps in the process or method for fabricating the nuclear waste canister of FIG. 1.

FIG. 8 is a process flow chart summarizing the foregoing steps in fabricating a welded nuclear waste canister which is resistant to the onset of stress corrosion cracking (SCC). The process or method 50 starts in step 52 by providing a stainless steel shell 26 having an open longitudinal joint 21 or circumferential joint 23 with shell weld end or edge 30 preparations selected commensurate for the type of weld to be made. In one preferred but non-limiting embodiment, hybrid laser welding and end preparations may be used. In step 54, the weld is formed as previously describe herein. In set 56, through-thickness compaction (TTC) is performed. In a final optional step 58, surface peening may be performed to add an additional layer of protection against SCC at the outer surface 24 of the shell 28 in the weld and HAZ.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A method for fabricating a nuclear waste canister, the method comprising:

providing the nuclear waste canister which is comprised of a stainless steel sheet or sheets configured for holding nuclear waste, the sheet or sheets including an exterior surface, an interior surface, and an open joint defined between adjacent edges of the sheet or sheets;

forming a full thickness weld in the open joint, the weld extending from the interior surface of the sheet or sheets to a convexly rounded crown at the exterior surface of the sheet or sheets;

compressing the weld for a full thickness of the weld;

flattening the crown of the weld such that the crown after compressing is substantially flush with the exterior surface of the sheet or sheets adjoining the weld; and thereafter surface peening the weld and an adjoining heat affected zone at the exterior surface of the sheet or sheets;

wherein forces delivered during the compressing step are sufficient to convert tensile stresses created in the sheet or sheets from forming the weld to compressive stresses for a full thickness of the shell or shells from the interior surface to the exterior surface; wherein the weld is a double V-groove weld defining an interior weld mass formed at the interior surface of the sheet or sheets at the joint, and an exterior weld mass formed at the exterior surface of the sheet or sheets at the joint; and wherein the interior weld mass is widely larger than the exterior weld mass.

2. The method according to claim 1, wherein the edges of the sheet or sheets are linear.

3. The method according to claim 1, wherein the weld is formed by hybrid laser welding.

4. The method according to claim 1, wherein the weld is a double V-groove weld formed by double-sided submerged arc welding.

5. The method according to claim 1, wherein the exterior weld mass is made first during forming the weld and the interior weld mass is made second.

6. The method according to claim 1, wherein the weld is a hybrid laser weld formed by a hybrid laser welding technique.

7. The method according to claim 1, wherein the hybrid laser weld is made from the interior surface of the shell or shells.

8. A method for fabricating a nuclear waste canister comprising:

providing the nuclear waste canister comprised of a stainless steel shell or shells for a nuclear waste canister, the shells or shells including an exterior surface, an interior surface, a thickness defined therebetween, a pair of spatially separated opposing edges to be joined defining an open weld joint;

the weld joint having a profile comprising an exterior V-groove which is widely smaller than an interior V-groove;

forming a full thickness weld in the weld joint by first forming a V-shaped exterior weld mass at an exterior of the weld joint followed by forming a V-shaped interior weld mass at an interior of the weld joint, the weld extending from the interior surface to the exterior surface of the shell or shells;

compressing the full thickness weld from the interior surface to the exterior surface of the shell or shells;

wherein the weld is a double V-groove weld in which the interior weld mass is widely larger than the exterior weld mass prior to any machining of the weld.

9. The method according to claim 8, further comprising a step of compressing the weld for a full thickness of the weld such that a crown of the exterior weld mass is flattened and substantially coplanar with the exterior surface of the shell or shells adjoining the weld.

10. The method according to claim 9, wherein the compressing step is sufficient to convert a tensile stress field created in the weld and an adjoining heat affect zone of the sheet or sheets from forming the weld to a compressive stress field for a full thickness of the shell or shells from the interior surface to the exterior surface.

11. The method according to claim 10, wherein after the compressing step, further comprising a step of surface peening the weld and an adjoining heat affected zone at the exterior surface of the shell or shells.

12. A method for fabricating a nuclear waste canister comprising:

providing the nuclear waste canister comprised of a stainless steel shell or shells configured for holding nuclear waste, the shells or shells including an exterior surface, an interior surface, a thickness defined therebetween, and an open weld joint;

the weld joint having a profile comprising an exterior V-groove which is widely smaller than an interior V-groove;

forming a full thickness weld in the weld joint; and compressing the full thickness weld from the interior surface to the exterior surface of the shell or shells;

wherein the compressing step induces at least 5%, but no more than 10%, maximum compressive strain in the weld and heat affect zone adjoining the weld.

13. The method according to claim 1, wherein the compressing step induces at least 5%, but no more than 10%, maximum compressive strain in the weld and heat affect zone adjoining the weld.

* * * * *